US006095778A

United States Patent [19]

Galante

[11] Patent Number: 6,095,778

[45] Date of Patent: Aug. 1, 2000

[54] SCROLL THRUST BEARING/COUPLING APPARATUS

[75] Inventor: Christopher Robert Galante, Westland, Mich.

[73] Assignee: Ford Motor Company, Dearborn, Mich.

[21] Appl. No.: 09/087,880

[22] Filed: Jun. 1, 1998

[51] Int. Cl.[7] ..... F01C 1/02

[52] U.S. Cl. ..... 418/55.3; 464/103

[58] Field of Search ..... 418/55.3; 464/103

[56] References Cited

U.S. PATENT DOCUMENTS

| | | | |
|---|---|---|---|
| 3,905,207 | 9/1975 | Garrison . | |
| 4,259,043 | 3/1981 | Hidden et al. . | |
| 4,487,591 | 12/1984 | Berg . | |
| 5,147,192 | 9/1992 | Suzuki et al. . | |
| 5,178,526 | 1/1993 | Galante et al. . | |
| 5,221,198 | 6/1993 | Izumi et al. | 418/55.3 |
| 5,758,978 | 6/1998 | Satoda et al. | 418/55.3 X |
| 5,813,843 | 9/1998 | Suefuji et al. | 418/55.3 |
| 5,911,566 | 6/1999 | Terauchi et al. | 418/55.3 |
| 5,915,933 | 6/1999 | Iizuka et al. | 418/55.3 |

FOREIGN PATENT DOCUMENTS

| | | |
|---|---|---|
| 62-3101 | 1/1987 | Japan . |
| 63-179185 | 7/1988 | Japan . |
| 4-164182 | 6/1992 | Japan . |
| 5-118324 | 5/1993 | Japan . |

OTHER PUBLICATIONS

Improvement of Scroll Compressor for Vehicle Air Conditioning Systems, SAE Technical Paper Series 970113, p. 55–70, J. Lizuka, N. Kitano, S. Ito and S. Otake 1997.

*Primary Examiner*—Hoang Nguyen
*Attorney, Agent, or Firm*—Raymond L. Coppiellie

[57] ABSTRACT

A combination thrust bearing/coupling apparatus is provided to simultaneously couple an orbiting scroll member with a stationary scroll member. Axial load carrying rolling spheres are provided between the locating indentations of the scroll members. The relative diameters of the spheres and width of the locating indentations permit the spheres to travel a distance equal to one-half of the orbit radius of the orbiting scroll member in all directions from a central position in the respective pair of locating indentations to maintain the predetermined angular relationship between said scroll members. A pair of facing clearance indentations are provided in the orbiting and fixed members. A sphere is provided between the clearance indentations. The relative diameters of the spheres and width of said clearance indentations permit the spheres to travel a distance greater than one-half of said orbit radius of said orbiting scroll member in all directions from a central position in the pair of clearance indentations.

9 Claims, 3 Drawing Sheets

SCROLL THRUST BEARING/COUPLING APPARATUS

FIELD OF THE INVENTION

This invention relates to a combination thrust bearing/coupling apparatus, and more particularly to such an apparatus for a scroll type compressor.

BACKGROUND OF THE INVENTION

U.S. Pat. No. 4,259,043, which is incorporated herein by reference, describes a thrust bearing/coupling component for a scroll type mechanism. In the '043 patent, a plurality of balls are provided to permit relative movement between the scroll members while limiting radial movement and reacting to axial forces. Because each of these balls is received in a machined pocket, the pocket must be precisely formed. By having a plurality of such pockets, manufacturing tolerances must be held tightly to ensure that diametrically opposed pockets are not formed in a manner which causes the diametrically opposed balls to resist relative radial movement.

It would therefore be desirable to design an improved thrust bearing/coupling apparatus which provides for improved manufacturability by reducing the number of critical dimensions therein.

SUMMARY OF THE INVENTION

It is thus an object of the present invention to provide a scroll thrust bearing/coupling apparatus having a minimal number of critical dimensions to simplify the manufacture thereof.

Accordingly, a combination thrust bearing/coupling apparatus is provided to simultaneously couple an orbiting scroll member with a stationary scroll member in a predetermined angular relationship while carrying axial loads imposed on the scroll members. The orbiting scroll member has a predetermined orbit radius and a plurality of circumferentially spaced locating indentations. The stationary scroll member has a plurality of circumferentially spaced second locating indentations corresponding to and facing the first locating indentations. Axial load carrying rolling spheres are provided between the locating indentations. The relative diameters of the spheres and width of the locating indentations permit the spheres to travel a distance equal to one-half of the orbit radius of the orbiting scroll member in all directions from a central position in the respective pair of locating indentations to maintain the predetermined angular relationship between said scroll members. A pair of facing clearance indentations are provided in the orbiting and fixed members. A sphere is provided between the clearance indentations. The relative diameters of the spheres and width of said clearance indentations permit the spheres to travel a distance greater than one-half of said orbit radius of said orbiting scroll member in all directions from a central position in the pair of clearance indentations.

Thus, the manufacture of an apparatus according to the present invention is simplified, as the clearance indentations do not require precise machining.

DETAILED DESCRIPTIONS OF PREFERRED EMBODIMENTS

Figure 1:
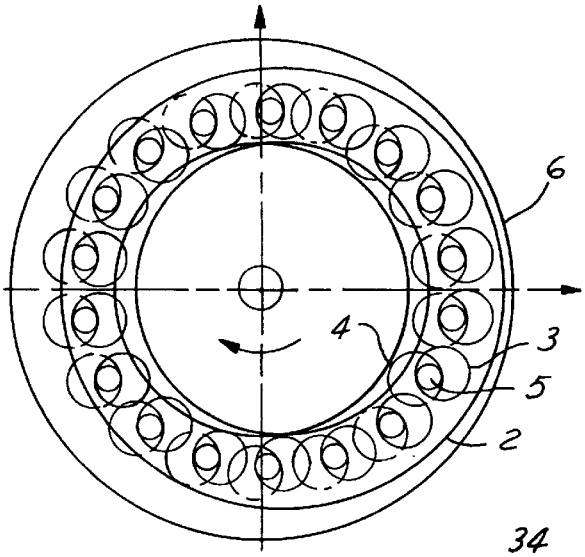
(PRIOR ART) FIG. 1
FIG. 1 is a cross-sectional view of an apparatus according to the prior art.

As described in detail in U.S. Pat. No. 4,259,043, FIG. 1 illustrates a portion of a prior art scroll apparatus which accommodates axial loading and retains the scroll members in relative radial position in a predetermined orbital motion. As described in the '043 patent, a rotating ring 2 includes a plurality of holes 3 and a fixed ring 6 includes a plurality of corresponding holes 4. A ball 5 is provided between the fixed and rotating rings 2, 6. Each of the balls 5 is trapped between each of the holes 3, 4 as illustrated in prior art FIG. 1. The entrapment of the balls 5 between the machined holes 3, 4 in the rings 2, 6 creates multiple interferences therebetween at each ball 5. These interferences create a difficult manufacturing situation, wherein each of the holes 3, 4 must be precisely formed to capture the ball 5 therebetween.

Figure 2:
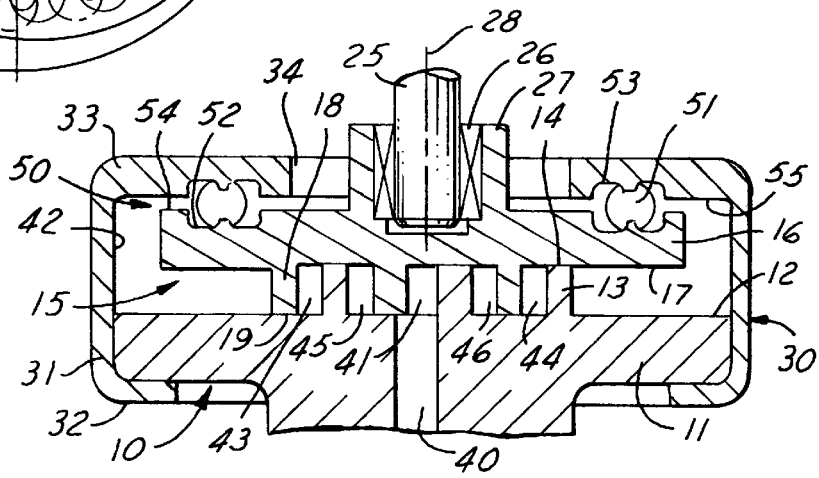
FIG. 2 is a longitudinal cross-section through a scroll type apparatus according to the present invention.

FIG. 2 illustrates a longitudinal cross sectional view of a scroll compressor according to the present invention. The scroll apparatus is designed to serve as a compressor, expander or vacuum pump. This apparatus comprises a stationary scroll member 10 having an end plate 11 with a facing contacting surface 12 and a stationary involute wrap 13 having an involute contacting sealing surface 14. An orbiting scroll member 15 is provided facing the stationary member 10. The orbiting member 15 includes having an end plate 16 with a facing contacting surface 17 and an orbiting involute wrap 18 having an involute contacting/sealing surface 19. The orbiting scroll member 15 is driven by a suitable driving means through shaft 25 mounted to orbiting scroll member 15 through bearing 26 seated in bearing housing 27 which is conveniently an integral part of orbiting end plate 16. The axis 28 of the input shaft 25 is parallel but spaced from the machine axis 29 by a distance similar but not necessarily equal to the orbit radius of the scroll apparatus. Scroll members 10 and 16 are located within a housing 30, which is affixed or made integral with the stationary member 15. In this embodiment, the housing 30 includes a radial face 55 opposed to a radial face provided on the rotating member 15 for supporting a plurality of balls 51 as described below.

A fluid passage 40 provides fluid communication with the central fluid pocket 41; and annular fluid passage 34 provides fluid communication outside a peripheral fluid chamber 42. A series of fluid pockets 43, 44, 45 and 46 are provided between the peripheral chamber 42 and the central fluid pocket 41, the zone of highest pressure, wherein the pressure increases inwardly in a known manner. When the apparatus serves as a compressor, fluid is taken in through annular passage 34 and compressed fluid is discharged through passage 40; when it serves as a vacuum pump or liquid pump, the fluid may be directed either radially inward or outward; and when it serves as an expander, compressed fluid will be introduced through passage 40 and expanded fluid will be discharged through annular passage 34.

Orbiting scroll member 15 must be located with respect to the stationary scroll member 10 within a fixed, predetermined angular relationship. Coupling is customarily done through the use of a separate coupling member (see, for example, U.S. Pat. Nos. 3,924,977 and 4,121,438, which presents separate problems of wear, alignment, and assembly.

Because the scroll apparatus experiences radial and axial pressure gradients, it is necessary to provide some means to urge sealing contact between stationary end plate surface 12 and orbiting involute surface 19 on one hand and orbiting end plate surface 17 and stationary involute surface 14 on the other hand. Such sealing contact may be through axial compliance sealing means. A form of axial loading and axial compressive load carrying means capable of controlling the wearing of the contacting surfaces is also provided. An axial load on the scrolls may be generated by the means used to effect radial sealing or by the fluid itself as it flows through the apparatus.

In the present invention, a single component is used to combine the functions of the thrust carrying means and the coupling means. This component is referred to as the thrust bearing/coupling component. The thrust bearing/coupling component, generally indicated by the reference numeral 50, comprises a plurality of spheres 51, each of which is confined to a continuous rotary motion within facing circular indentations 52 and 53 in orbiting scroll end plate surface 54 and in the internal surface 55 of the fixed member 10. The spheres 51 are preferably ball bearings, but alternatively could be cones or cylinders.

Figure 3:
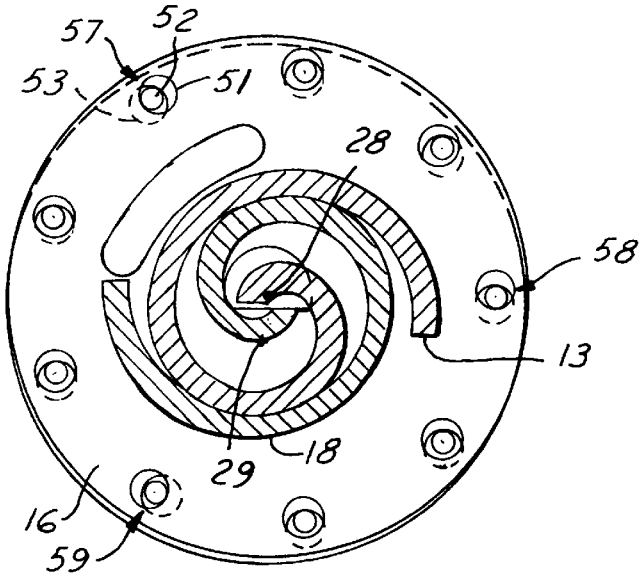
FIG. 3 is a cross-section of the apparatus of FIG. 2.

FIG. 3 provides a diagrammatic elevational sectional view of the compressor shown in FIG. 2, in which the plurality of balls 51 are illustrated between the plurality of indentations 52, 53 provided in the fixed member 10 and orbiting member 15 of the compressor. FIG. 3 illustrates the relative position of indentations 52 and 53 for the scroll element for one point in the orbit cycle. It will be seen from this figure that the centers of indentations 52 and 53 of the stationary and orbiting scroll members are located on circles having the same radius. Three sets of indentations 57, 58, 59 serve to relatively locate the rings by providing an interference fit between the spheres 51 and locating indentations 57, 58, 59. Each of these three locating indentations thereby limits relative movement between the scrolls in a single direction and thus maintains the relative position therebetween. Preferably, the three indentations 57, 58 and 59 are spaced 120 degrees apart. In a preferred embodiment, four equally spaced indentations are provided between each two adjacent locating indentations, or 15 indentations 52, 53 each, equally spaced about the circumference, in each member 10, 15.

Figure 4A:
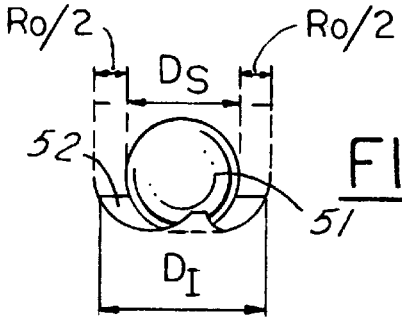
FIGS. 4 *A—D* presents details in cross-sectional views and diagrammatic plan view of the components of the trust bearing/coupling of FIG. 3.
Figure 4B:
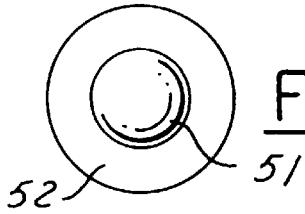

FIG. 4A illustrates diagrammatically the size of the indentations 52 and 53 relative to the diameter, $D_5$ of a sphere and the orbit radius $R_0$ of the orbiting scroll member 15. In its movement during an orbiting cycle, a sphere 51 must be able to travel a distance equal to one-half of the orbit radius, i.e., $R_0/2$, in all directions from a theoretical central position. Thus, the ball 51 must be able to travel in a circular path within these parameters within indentations 52, 53 as shown in FIGS. 4A and 4B. In prior art couplings, all of the ball pockets had to be precisely formed to ensure that all of the balls could travel within these requirements. Because the present invention uses only preferably three such pockets, only these three pockets must be so precisely machined.

Figure 4C:
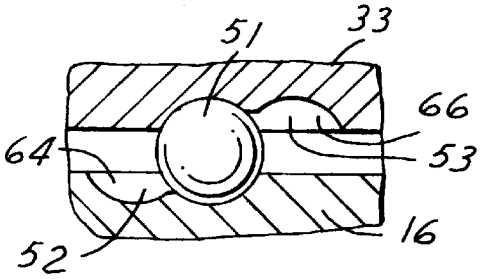

As illustrated in FIG. 4C, which is an enlarged cross section of the indentations 52, 53 showing the manner in which the orbiting scroll member end plate 16 and stationary scroll member 10 trap the balls 51 therebetween to maintain the members 15, 16 in the desired angular relationship using the three locating indentations 57, 58, 59. The diameters of spheres 51 and the depths of indentations 52 and 53 are preferably so sized that a small (e.g., 0.001 inch) running clearance is maintained during operation between surfaces 12 and 19 and between surfaces 14 and 17 to minimize surface wear while at the same time optimizing radial sealing. It will thus be apparent that the spheres 51 in their continuous rotary motion serve to carry the expansive thrust or loads which tend to separate the scroll members as well as to couple them.

Figure 4D:
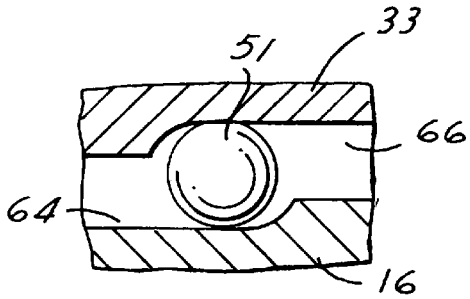

FIG. 4D illustrates the remainder of the indentations 52, 53 spaced about the fixed and rotating members 10, 15 (other than the three locating indentation pairs 57, 58 and 59). At least one of the indentations 52, 53 is oversized to provide radial clearance to the ball 51 so as to not provide substantial radial resistance to orbital movement of the members 10, 15. Therefore, these other indentations 52, 53 do not require the precise machining of the locating indentations 57, 58 and 59.

Figure 5:
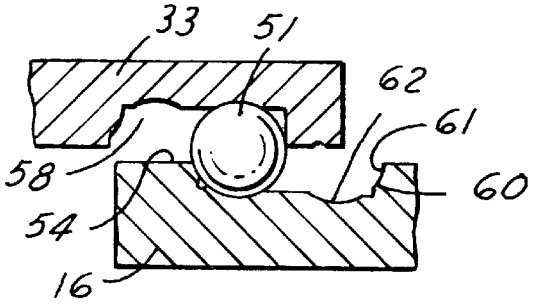
FIG. 5 illustrates, in partial cross section, a modified configuration of the invention shown in FIG. 4.
Figure 6:
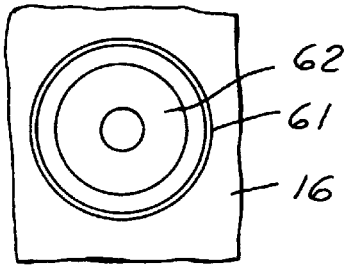
FIG. 6 is a plan view of the apparatus shown in FIG. 5.

The cross sectional configuration of the circular indentations 52 and 53 illustrated in FIG. 4A is an ideal configuration which may be somewhat difficult to machine in the surfaces of the scroll and housing members. In alternate embodiments, the indentations may be cut with chamfered walls as described in conjunction with FIGS. 5 and 6 or with straight walls. In FIGS. 5 and 6, indentations 58 and 59 are shown to have straight sides 60 with chamfered lips 61 and contoured bottom channels 62, the configurations of the lips 61 and channels 62 in combination, corresponding to the spherical configuration of the spheres 51. The indentation embodiment of FIGS. 5 and 6 is relatively easy to machine, thus making it attractive for low-cost apparatus.

Figure 10:
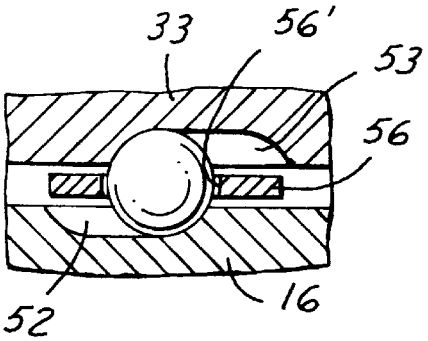
FIG. 10 is a partial sectional view of an apparatus according to a further alternative embodiment of the present invention.

The orbiting scroll end plate 15 has a plurality of indentations 64 cut therein which are equally spaced circumferentially about the plate 15. Fixed member 10 likewise has a plurality of equally spaced indentations 66 cut in surface 55. A sphere 51 experiences continuous circular motion in the facing indentations 64 and 66 each of which are cut to a depth such that their combined depths is slightly less than the diameter of spheres 51 to prevent contact between surfaces 54 and 55 while ensuring that spheres 51 are always restrained within the confines of the facing indentations. Thus, in a preferred embodiment, a retainer ring, such as 56 of FIG. 10, is not required.

Thus, only the circular indentations require machining on the surface 54, 55 of the ring 10, 15, and only the locating indentation pairs 57, 58, 59 require precise machining. In the embodiment of FIG. 10, the holes 56' of the retaining ring 56 also require machining. Commercially available ball bearings may be used as the thrust carrying spheres and the entire assembly is simple and straightforward, presenting essentially no problems of alignment, adjustment, or assembly.

Figure 7:
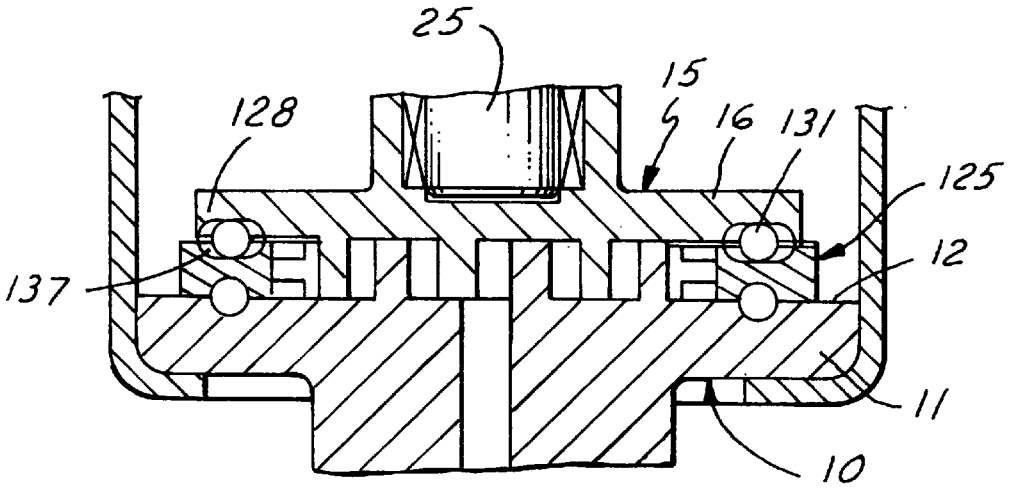
FIG. 7 is a longitudinal cross-section through a scroll type apparatus according to an alternative embodiment of the present invention.
Figure 8:
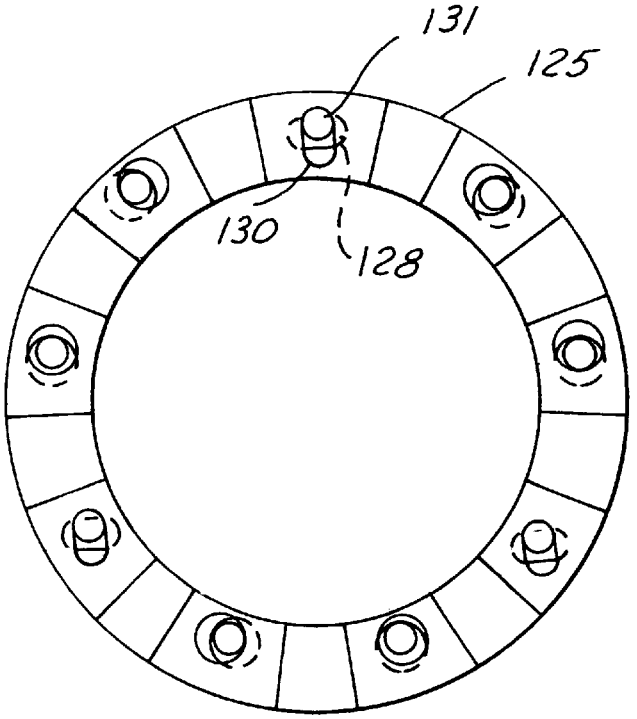
FIG. 8 a cross-sectional plan view of the apparatus of FIG. 7.
Figure 9:
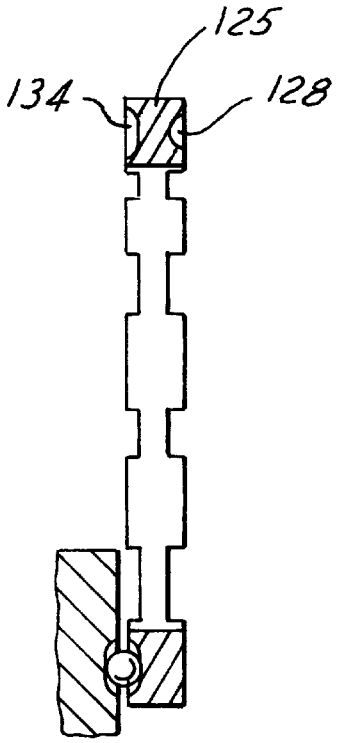
FIG. 9 is a partial cross sectional view through the apparatus of FIG. 7.

A further alternative embodiment is illustrated in FIGS. 7–9. In this embodiment, the bearing/coupling means includes a ring 125 interposed between fixed and orbiting members 10, 15. A plurality of balls 131 are interposed between the ring 125 and members 10, 15, each of which has a plurality of circumferentially spaced indentations 128, 130 formed therein acting as bearing surfaces for the balls 131 in a similar manner to the indentations 52, 53 of FIG. 2. Three of the indentation pairs act as locators. The remainder of the indentations 128, 130 have radial clearance so as to not locate the balls 131. The locating indentations are formed such that the ring has a longitudinal groove 128 opposite a groove 130 in the orbiting plate 15. The groove 130 is perpendicular the groove 128 in the plate. Thus, as the plate 15 orbits, the lateral component of the orbiting motion in a first direction is handled by one of the grooves 128 or 130, while movement perpendicular the first direction are handled by the second of the grooves 128 or 130.

Again, the remainder of the grooves are oversized indentations (or perhaps oversized longitudinal grooves) to ensure the non-locating indentations do not oppose movement of the plates 10, 15.

As illustrated in FIG. 10, the orbiting and fixed members 10, 15 may be maintained in radial and circumferential alignment by a sphere retainer ring 56 having holes 56 drilled therethrough. Like the embodiments discussed above, the holes 56 are circumferentially spaced about the ring 56. Three of the holes, preferably 120 degrees apart locate the balls 51. Alternatively, a combination of the indentations 52, 53 and holes 56 may be used to locate the spheres 51, but a clearance must be provided to the non-locating elements to avoid interference therefrom.

Although FIG. 10 illustrates a straight hole 56, the holes 56 may have a chamfer formed therein (not shown in FIG. 10) to minimize the friction losses incurred between the balls 51 and ring 56 and improve the manufacturability thereof.

The various components of these scroll devices, i.e., the scroll members and housing means, may be formed of suitable plastic materials (e.g., polyimides and the like) or of metal, depending upon the function of the apparatus. For example, pump components may be formed of plastic, while compressors and expanders will normally be formed of a metal such as gray iron or aluminum. The machining operations required to cut the indentations are well developed, and commercially available ball bearings are suitable for the load carrying members.

It will thus be seen that the objects set forth above, among those made apparent from the preceding description, are efficiently attained and since certain changes may be made in the above constructions without departing from the scope of the invention, it is intended that all matter contained in the above description or shown in the accompanying drawings shall be interpreted as illustrative and not in a limiting sense.

What is claimed is:

1. A scroll compressor comprising:

a housing having a radial face;

a stationary scroll member located within the housing, the stationary scroll member including an end plate with a facing contact surface and a stationary involute wrap having an involute contacting sealing surface;

an orbiting scroll member located within the housing, the orbiting scroll member including an end plate with a facing contacting surface, an orbiting involute wrap having an involute sealing surface, and a end plate surface approximately parallel to the radial face of the housing;

means for driving the orbiting scroll member; and a thrust bearing/coupling component having (i) three sets of cooperating locating indentations and three spheres, wherein each of the three sets of cooperating locating indentations includes a first locating indentation formed in the end plate surface of the orbiting scroll member and a second locating indentation formed in the radial face of the housing and aligned with the first indentation, wherein a sphere is provided between the first and second locating indentations, wherein the locating indentations and spheres are sized to permit a sphere to travel a distance equal to one-half of an orbit radius of the orbiting scroll member in all directions from a central position, and (ii) a plurality of cooperating clearance indentations provided in the end plate surface and the radial face and a sphere between each of the clearance indentations, wherein the clearance indentations and the spheres are sized to permit a sphere to travel a distance greater than one-half of the orbit radius in all directions from a central position.

2. The scroll compressor defined in claim 1 wherein the diameters of the spheres and the depth of the first and second indentations are sized so that a running clearance is maintained between the stationary and orbiting scroll members.

3. The scroll compressor defined in claim 2 wherein the running clearance is approximately 0.001 inch.

4. The scroll compressor defined in claim 1 wherein the locating indentations are spaced approximately 120 degrees apart.

5. A scroll compressor comprising:

a stationary scroll member having a planar surface an orbiting scroll member having a planar surface approximately parallel to the planar surface of the stationary scroll member;

means for driving the orbiting scroll member; and a thrust bearing/coupling component having (i) three sets of cooperating locating indentations and three spheres, wherein each of the three sets of cooperating locating indentations includes a first locating indentation formed in the planar surface of the orbiting scroll member and a second locating indentation formed in the planar surface of the stationary scroll member and aligned with the first indentation, wherein a sphere is provided between the first and second locating indentations, wherein the locating indentations and spheres are sized to permit a sphere to travel a distance equal to one-half of an orbit radius of the orbiting scroll member in all directions from a central position, and (ii) a plurality of cooperating clearance indentations provided in the end plate surface and the radial face and a sphere between each of the clearance indentations, wherein the clearance indentations and the spheres are sized to permit a sphere to travel a distance greater than one-half of the orbit radius in all directions from a central position.

6. The scroll compressor defined in claim 5 including a retaining ring interposed between the stationary and orbiting scroll members, the ring having a plurality of spaced holes to accommodate the spheres.

7. The scroll compressor defined in claim 6 wherein the three of the first indentations are formed as longitudinal grooves, and wherein three holes in the retaining ring are formed as longitudinal grooves opposite the longitudinal grooves of the radial face, so that the spheres in the longitudinal grooves act as locators.

8. The scroll compressor defined in claim 7 wherein the longitudinal grooves of the radial face are approximately perpendicular to the grooves of the retaining ring.

9. The scroll compressor defined in claim 5 wherein the locating indentations are spaced approximately 120 degrees apart.

* * * * *